US006607224B2

(12) United States Patent
Hodges

(10) Patent No.: US 6,607,224 B2
(45) Date of Patent: Aug. 19, 2003

(54) LOCKING OR LATCHING MECHANISM

(75) Inventor: Andrew Hodges, Downham Market (GB)

(73) Assignee: Foster Refrigerator (UK) Limited (GB)

( * ) Notice: Subject to any disclaimer, the term of this patent is extended or adjusted under 35 U.S.C. 154(b) by 0 days.

(21) Appl. No.: 09/923,276

(22) Filed: Aug. 6, 2001

(65) Prior Publication Data

US 2002/0021011 A1 Feb. 21, 2002

(30) Foreign Application Priority Data

Aug. 9, 2000 (GB) ..... 0019598
May 23, 2001 (GB) ..... 0112605

(51) Int. Cl.[7] ..... E05C 19/00
(52) U.S. Cl. ..... 292/303; 292/17; 292/DIG. 55
(58) Field of Search ..... 292/303, 304, 292/340, 341.15, 341.17, 17, 19, DIG. 55

(56) References Cited

U.S. PATENT DOCUMENTS 984,118 A * 2/1911 Wilcox ..... 16/85
2,486,003 A * 10/1949 Christensen ..... 24/643
2,946,612 A * 7/1960 Ahlgren ..... 24/662
3,086,803 A * 4/1963 Wilson ..... 16/85
3,638,285 A * 2/1972 Sanchez Giraldez ..... 24/108
3,659,442 A * 5/1972 Cellini et al. ..... 292/19
3,776,580 A * 12/1973 James ..... 292/17
4,022,504 A * 5/1977 Anderson ..... 292/17
4,159,138 A * 6/1979 Smith ..... 292/214
4,250,599 A * 2/1981 Nagashima et al.
4,597,599 A * 7/1986 Bisbing ..... 292/174
5,226,302 A * 7/1993 Anderson ..... 292/341.18
6,149,213 A * 11/2000 Sokurenko et al. ..... 292/174

* cited by examiner

*Primary Examiner*—Gary Estremsky
*Assistant Examiner*—Mark Williams
(74) *Attorney, Agent, or Firm*—Thompson Hine LLP

(57) ABSTRACT

Locking or latching mechanism with a striker having an enlarged head and a keep. The enlarged head of the striker is able to pass into an opening of the keep. The keep retains the head of the striker in a locked or latched condition. The keep is loosely mounted to permit automatic alignment between the striker and the keep.

14 Claims, 2 Drawing Sheets

LOCKING OR LATCHING MECHANISM

CROSS REFERENCE TO RELATED APPLICATIONS

This application claims priority from British Patent Application No. 0019598.2 filed on Aug. 9, 2000 and British Patent Application No. 0112605.1 filed on May 23, 2001.

The present invention relates to a locking or latching mechanism, and in particular to a locking or latching mechanism for locking or latching a door to a door frame.

There are many different types of locks and latches known for different purposes. A common lock for locking doors, for example cupboard or cabinet doors, is known as a twist lock. This comprises a striker having an enlarged, flattened head that is receivable within a keep through an opening in the keep. The striker is rotatable between a first position in which the enlarged head is able to pass through the opening of the keep, and a second position in which the enlarged head is unable to pass through the opening in the keep. The striker may be rotated freely, for example by a handle when the mechanism is used merely as a latch, or may require a key to be rotated where the mechanism is to be used as a security lock. With such an arrangement, the striker is turned to a position such that the enlarged head may pass through the opening of the keep when it is desired to unfasten the lock, and to a position in which the enlarged head is unable to pass through the opening of the keep when the lock is to be fastened.

Where such locks are used for cupboard or cabinet doors, it is usual for the striker to be provided on the door, and the keep to be mounted on the door frame. One application for such locks is for refrigerators, especially industrial or commercial refrigerators that may contain goods of considerable value that need to be secured.

A problem with known twist locks is that they require accurate alignment between the striker and the keep. For example, where the lock is provided on a cupboard or cabinet, there is the possibility that some misalignment may occur during use between the striker and the keep. This is especially the case for large cabinets or cupboards where a small movement in the connection between the door and the carcass of the cupboard near the hinge will result in a relatively large movement between the door and carcass at the locking position. As a result of this, there is the risk that, when the door is closed, the striker will not align with and pass into the opening of the keep, but instead will strike the keep itself. This is liable to cause damage to the locking mechanism. Commonly, this will result in the locking barrel being forced from the locking mechanism, causing damage to the locking mechanism.

A further problem occurs where an attempt is made to close the door whilst the striker is in a locked position. For example, where the lock is provided on a cupboard or refrigerator that need frequently to be opened and closed, it is not uncommon for the keys to be left in the lock. In this case, there is a risk that when the door is open, the striker will accidentally be turned to the locked position. When the door is then closed, the striker will hit the keep, not being able to pass through the opening. This is liable to cause damage similar to that caused when the striker and keep become misaligned. A further problem in this case is that the attempt to close the door will be unsuccessful. Especially where the door must be kept closed, for example where the door is the door of a cold storage chamber such as a refrigerator, and if the door is left open this may lead to the temperature in the chamber exceeding an acceptable level, this may present a considerable problem.

However damage occurs to a lock, this will cause inconvenience and expense. If it is not possible to lock the door, there is a security risk. Further, the lock will require repair or replacement.

According to the present invention, a locking or latching mechanism comprises a striker having an enlarged head and a keep, the keep including an opening through which the enlarged head of the striker can pass, in which the mechanism is in a locked or latched condition when the enlarged head of the striker is received by and retained by the keep, the keep being provided loosely within a housing to permit automatic alignment between the striker and the keep when the striker is moved towards and into the keep.

With the mechanism according to the present invention, a greater degree of misalignment between the striker and the keep is permitted, whilst not affecting the operation of the locking or latching mechanism, and without causing damage to the lock or latch. In particular, if there is misalignment between the striker and the keep as the striker is moved into contact with the keep, the keep will have a degree of freedom of movement allowing it to align automatically with the striker.

It is preferred that the keep is formed of a resilient material. In this way, even if the keep is not able to move into perfect alignment with the striker, the resilience of the keep will allow this to deform to allow the opening in the keep to expand to allow the striker to pass through the opening without causing damage to the locking mechanism. In one aspect, the keep may be fixed at certain points, with the looseness being achieved in the region through which the striker passes by the resilience of the keep. Forming an angled entry into the opening of the keep may assist this.

A suitable resilient material from which the keep may be formed is steel.

Where the mechanism is to be used as a latch, the normal opening of the keep should be smaller than the enlarged head of the striker. In this case, when the striker is moved towards the keep, the keep is resiliently deformed to allow the enlarged head to pass into the keep. When the enlarged head has passed into the keep, the keep reverts to its normal configuration, retaining the enlarged head within the keep to latch the mechanism closed. To open the mechanism, it is necessary to apply sufficient force to cause the keep to deform to allow the enlarged head of the striker to pass through the opening of the keep.

Where the mechanism is to operate as a lock, it is preferred that the enlarged head of the striker has a different width than height. In this case, by rotation of the striker about its axis, a different profile may be presented. In particular, the striker may be rotated to a position in which it is in general alignment with the opening of the keep, and in this position will be able freely to pass into and out of the keep. This is the unlocked condition. When the striker is rotated to a position out of alignment with the opening to the keep, the enlarged head will be unable to pass freely out of the keep. This is the locked condition.

The use of a resilient material for the keep, preferably also with an angled entry, helps prevent damage to the locking mechanism in the event that an attempt is made to close the mechanism whilst the striker is in a locked orientation. In this case, the keep will bend to increase the size of the opening, and will allow the striker to pass into the keep. In this case, the lock or latch will be in a locked state, but without causing damage to the mechanism. Also, this will allow the door to close, even if the striker has accidentally been turned to the locked orientation, and therefore will ensure that the door will not remain open. In this case, the door will be closed in the locked condition.

Where the mechanism is used as a lock in this way, it is preferred that the keep includes a shoulder on the inside of the opening, such that the enlarged head contacts this shoulder and prevents opening of the keep to allow the enlarged head to pass though the opening by the application of force. In this way, it is only possible to open the lock by turning the striker to bring this into alignment with the opening, in which alignment the enlarged head is able to pass easily through the opening of the keep.

The housing in which the keep is loosely provided preferably has a large opening corresponding to the opening of the keep at any position in which the keep may move.

In a preferred embodiment, the keep comprises a wire defining an opening through which the head of the striker passes, and which retains the head. This is of advantage as such a keep has minimal depth. In this case, it is preferred that the keep comprises at least two legs that define an opening, and in this case that the legs are formed as the legs of a generally U-shaped wire, or as the extensions of a coil. This allows the loose mounting of the keep. Advantageously, the wire is formed of a resilient material. Since the wire will be deformable in the direction of movement of the striker, it is preferred that at least one support is provided to limit the movement of the keep in the direction of the striker.

An example of the present invention will be described in accordance with the accompanying drawings, in which.

Figure 1:
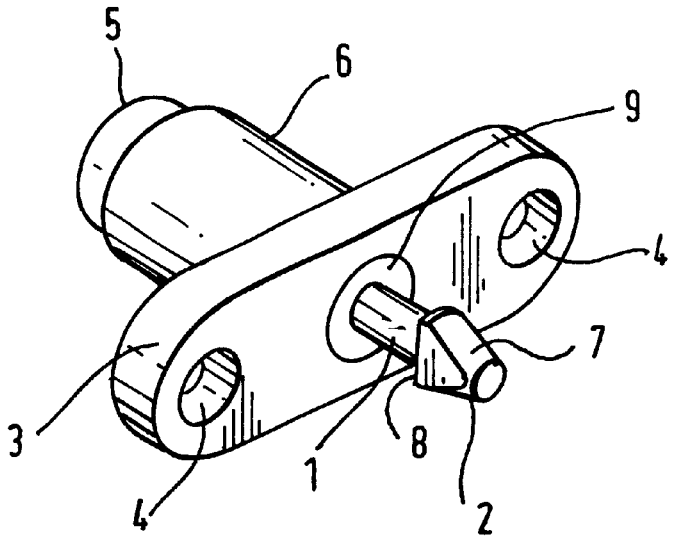
FIG. 1 shows an example of a lock body and striker.

The basic twist lock body as shown in FIG. 1 may be of a conventional design. This comprises a plate 3 that is attached to a surface, such as a door, by bolts or screws passing through holes 4 provided in the plate 3, or by any other suitable method. Extending from the plate 3 is a cylindrical body 6 in which is provided a barrel lock 5. The barrel lock 5 may be held in place within the cylindrical part 6 by a pin (not shown) which prevents axial movement of the lock 5 away from the lock body. A striker 1 having an enlarged head 2 is mounted to the lock 5 such that the striker 1 may be rotated about its axis by operation of a key. For low security applications, the striker 1 may merely be rotatably mounted within the cylindrical part 6 of the lock body, and may be connected to a handle, knob or other means for rotating the striker 1 without requiring a key.

The enlarged head 2 on the striker 1 has a larger height than width. The enlarged head 2 is formed with leading angled surfaces 7, and a square rear shoulder 8.

In a conventional twist lock of this type, a keep is provided with an elongate opening. To close the lock, the striker 1 is rotated to bring the enlarged head 2 into alignment with the elongate opening. In this orientation, the enlarged head 2 may pass freely into and out of the keep. To lock the locking mechanism, when the enlarged head 2 is located within the keep, the striker 1 is rotated, such that the enlarged head 2 cannot pass through the opening of the keep, but instead the rear shoulder 8 of the enlarged head 2 abuts against the rear of the opening of the keep.

Figure 2:
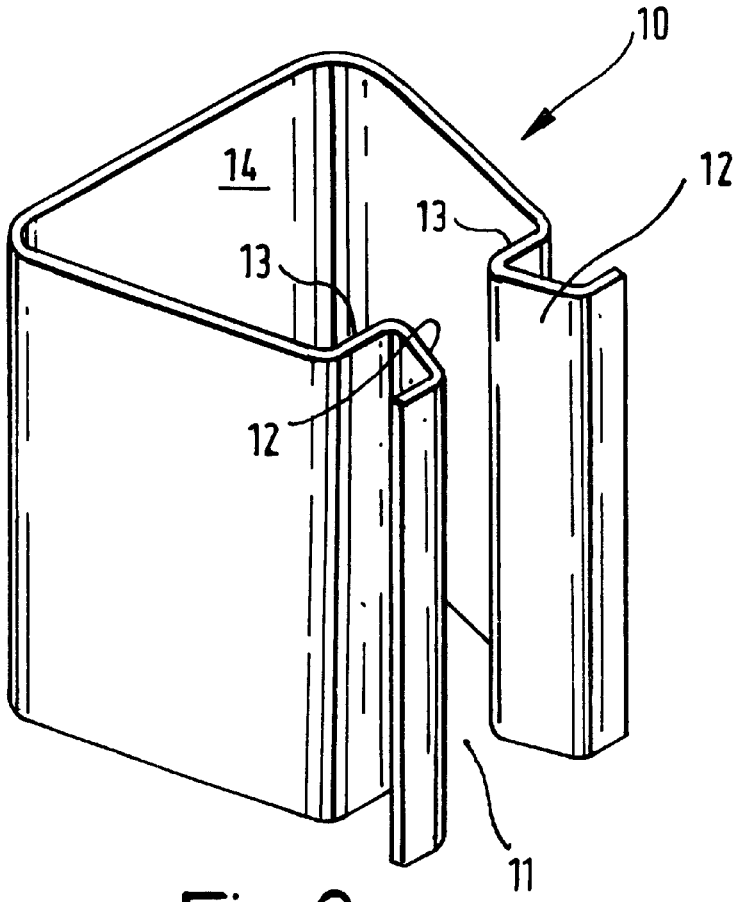
FIG. 2 shows a first example of a keep.

In the present invention, the keep is replaced by a floating keep, namely a keep that is loosely mounted within a housing. An example of a keep for use in the present invention is shown in FIG. 2. The keep 10 is formed from resilient steel or other suitable material. The keep 10 has an elongate opening 11 defined by a pair of converging surfaces 12. Behind the opening there is provided a pair of square shoulders 13 and an enlarged interior 14. The keep 10 is provided in a housing, which may comprise a generally solid housing connectable to a door frame by bolts or other suitable means, and having a large front opening that has a size greater than the opening 11 of the keep 10, but that is smaller than the keep 10 to prevent the keep 10 from falling out. Other alternative housings may include an upper and lower support that hold the top and bottom of the keep 10, but allow the keep 10 to twist within the housing.

In use, the striker 1 is rotated to orientate the enlarged head 2 with the opening 11 in the keep 10, and the lock brought towards the keep 10 so that the enlarged head 2 passes into the keep 10. The striker 1 is then rotated through 90° and in this position, if any attempt is made to withdraw the enlarged head 2 from the keep 10, the rear shoulder 8 of the enlarged head 2 abuts against the shoulders 13 of the keep 10 to prevent this. To unlock the lock, it is necessary for the striker 1 to be rotated back through 90° to orientate the enlarged head 2 with the opening 11 of the keep 10, allowing the enlarged head 2 to pass through the opening 11. To this extent, the operation is similar to a conventional twist lock.

However, according to the present invention, if the lock body and the keep 10 are out of alignment, for example due to relative movement of the components on which the lock body and keep 10 are mounted, when the striker 1 comes into contact with the keep 10, this will not be in alignment with the opening 11 of the keep 10. As the keep 10 is mounted loosely within a housing however, the contact between the enlarged head 2 of the striker 1 and the keep 10 will cause the keep 10 to turn or move into alignment with the striker 1, and therefore will allow the enlarged head 2 to pass through the opening 11 and into the keep 10. In this position, the striker 1 may be rotated to lock and unlock the mechanism in a conventional manner. Further, due to the resilience of the material from which the keep 10 is formed, and the angled entry surfaces 12 to the opening 11, the keep 10 will deform to enlarge the opening 11 to assist the passage of the enlarged head 2 into the keep 10. Accordingly, the permitted movement of the keep 10 allows a greater misalignment between the keep 10 and striker 1, whilst still allowing operation of the locking mechanism.

Furthermore, in the event that the striker 1 is rotated such that the enlarged head 2 is not orientated in the same direction as the opening 11 of the keep 10, the angled entry surfaces 12 to the opening 11 and the resilience of the keep 10 will allow the enlarged head 2 to pass through the opening 11. However, due to the flat rear shoulders 13 of the opening 11 of the keep 10, the enlarged head 2 will not be able to deform the opening 11 to pass out of the keep 10, and therefore the mechanism will remain in a locked condition.

A preferred feature of the present invention, which is not known in prior lock bodies, is the provision of a flange 9 on the striker 1 that abuts against the plate 3. In the event that an axial force is applied to the striker 1, for example if this were to be pushed against the housing holding the keep 10, the force would act upon the plate 3 rather than on the pin holding the barrel in place. Therefore, there is a reduced risk that the barrel will fall out with the present arrangement. As shown in FIG. 1, the flange may be received within a recess in the plate 3.

In an alternative example of the present invention, the striker 1 is not rotatable, but merely acts as a latch. In this case, the enlarged head 2 of the striker 1 is able to deform the opening 11 of the keep 10, such that it is able to pass through the opening 11. At this point, the resilience of the keep 10 will cause this to revert to its normal configuration, thereby holding the enlarged head 2 of the striker 1 within the keep 10. In this case, the keep 10 is not provided with square shoulders 13, but instead has angled shoulders. This allows the enlarged head 2 to separate the walls of the opening 11 of the keep 10 to permit the enlarged head 2 to be removed from the keep 10 by the application of a force pulling the head 2 from the keep 10. This gives a latch that is able to latch a door closed, but is able easily to be opened on application of the required force, without requiring unlocking.

Figure 3:
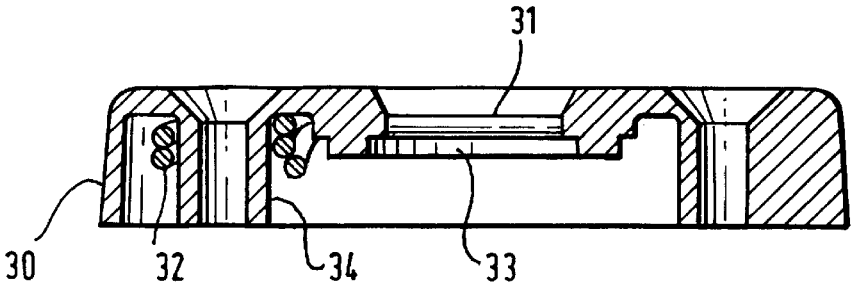
FIGS. 3 to 5 show a second example of a keep and housing.
Figure 4:
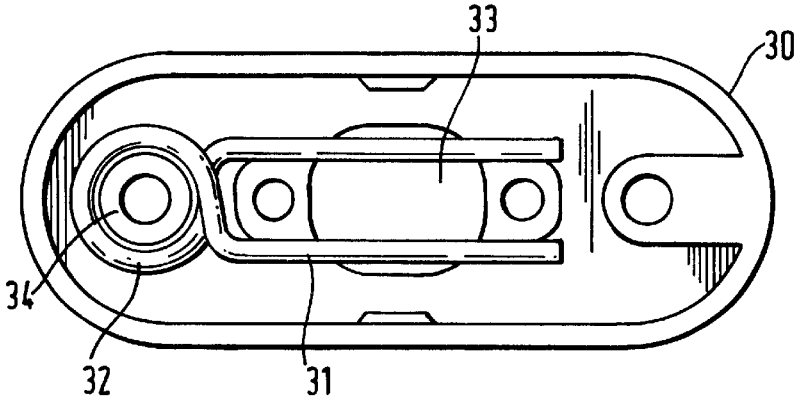
Figure 5:
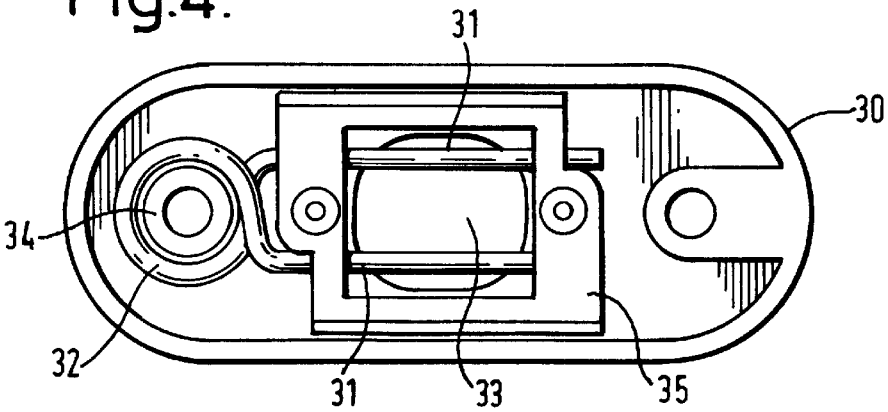
Figure 6:
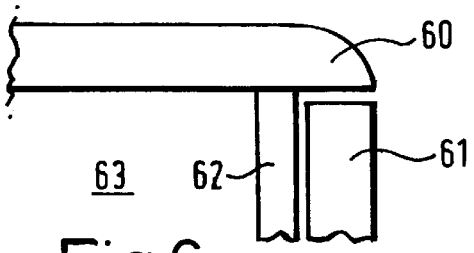
FIG. 6 shows a side view of a cabinet in which a lock or latch may be provided.

An alternative example of the present invention is shown in FIGS. 3 to 5. This example is designed to be of reduced height in comparison to the first example. This may be important in applications where there is minimal clearance, for example in an application such as a cabinet refrigerator as shown in side view in FIG. 6.

In this case, there may be provided a counter 60, with a door of the refrigerator 61 which is to be flush with the edge of the counter 60 when the door is closed. The door 61, when closed, contacts the frame 62 of the cabinet, and therefore the door lock must be provided in the door 61 and frame 62. Since it will be desired for the space 63 within the cabinet to be as large as possible, the size of the frame 62 and the door 61 should be minimised. Whilst the thickness of the door 61 is governed by the thickness of the insulation required, the thickness of the frame 62 can be reduced. However, where a deep keep arrangement, such as that described in the first embodiment, is used, the frame must be of sufficient thickness to accommodate this, thereby reducing the capacity of the refrigerator or other appliance.

In the arrangement shown in FIGS. 3 to 5, there is provided a housing or support 30. This includes a large opening 33 through which the enlarged head of a striker, similar to that shown in FIG. 1, can be received. The opening 33 is significantly larger than the head of the striker, such that even if the striker become mis-aligned, the housing 30 will not impinge on the movement of the striker.

As best shown in FIG. 4, a spring element is provided, including two legs 31 that pass over the opening 33 in the housing. The legs 31 restrict the size of the opening. The legs 31 are linked at one end by a coil 32, allowing the element to be formed from a single length of material. The coil 32 is mounted on a bush 34 of the housing 30, allowing the element to pivot around the bush 34, and in particular allowing the legs 31 to move. In this way, when the striker approaches the keep, if the striker is not in perfect alignment with the opening defined by the legs 31, the element will pivot, bringing the opening between the legs 31 into alignment with the striker, and allowing this to pass into the opening.

As the legs 31 of the element overlie the housing 30, the legs 31 are not able to be bent away from the striker as this approaches the keep, since the housing 30 prevents such movement.

The element is formed form resilient wire, such that in addition to the pivoting movement of the element, the legs 31 are able to splay apart to accommodate the enlarged head of the striker. This further compensates for any misalignment between the striker and the keep.

When the enlarged head of the striker passes through the opening defined by the legs 31 of the element, the rear of the enlarged head will be prevented from passing back through the keep in the same manner as the first example. In particular, due to the resilience of the legs 31, these will revert to their normal configuration after the enlarged head has passed through, and therefore the opening will revert to a size smaller than the enlarged head, preventing removal of the enlarged head. Additionally, where the arrangement is used as a lock, the rotation of the enlarged head will cause the longer dimension of the head to extend across the width of the opening, and therefore this will act to prevent removal of the head.

As shown in FIG. 5, a plate 35 is provided over the legs 31 of the keep element to prevent the legs 31 being bent outwardly in response to any attempt to pull the enlarged head of the striker through the opening.

It will be appreciated that, with either of the embodiments described, the movement of the keep may be achieved entirely by the resilience of the keep member. Accordingly, in the second example, the legs 31 could be fixed to the housing at one end, but, due to the resilience of the legs 31, these may move into alignment with the striker when the lock or latch is closed.

What is claimed is:

1. A locking or latching mechanism installed on a door and door frame, the mechanism comprising a striker extending from the door and having an enlarged head, a housing connected to the door frame and a keep, the keep including an opening through which the enlarged head of the striker can pass, in which the mechanism is in a locked or latched condition when the enlarged head of the striker is received and retained by the keep, the keep being formed as a part separate from the housing but provided loosely within the housing to permit relative movement between the keep when the striker is moved towards and into the keep via movement of the door toward the door frame, wherein the housing includes an opening that is larger than the opening of the keep but smaller than the keep itself to prevent the keep from falling out.

2. A mechanism according to claim 1, in which the keep is formed of a resilient material.

3. A mechanism according to claim 2, in which an angled entry surface is provided into the opening of the keep.

4. A mechanism according to claim 2, in which the keep is formed of steel.

5. A mechanism according to claim 2, in which the normal opening of the keep is smaller than the enlarged head of the striker.

6. A mechanism according to claim 1, in which the enlarged head of the striker has a different width than height such that rotation of the striker about its axis causes a different profile to be presented to the opening of the keep.

7. A mechanism according to claim 6, in which the keep includes a shoulder on the inside of the opening, such that the enlarged head contacts this shoulder and prevents opening of the keep to allow the enlarged head to pass though the opening by the application of force.

8. A mechanism according to claim 1, in which the housing in which the keep is loosely provided has a large opening corresponding to the opening of the keep.

9. A mechanism according to claim 1, in which the striker includes a flange that abuts against a base of the lock mechanism.

10. A mechanism according to claim 1, comprising a striker having an enlarged head and a keep, the keep including an opening through which the enlarged head of the striker can pass, in which the mechanism is in a locked or latched condition when the enlarged head of the striker is received and retained by the keep, the keep being formed as a part separate from the housing but provided loosely within a housing to permit automatic alignment between the striker and the keep when the striker is moved towards and into the keep, in which the keep comprises a wire member that is pivotally mounted to the housing.

11. A mechanism according to claim 10, in which the wire comprises a pair of legs defining the opening of the keep through which the head of the striker can pass.

12. A mechanism according to claim 11, in which the keep comprises a wire coil, the ends of which form the pair of legs defining the opening of the keep.

13. A mechanism according to claim 1, in which the keep is pivotally mounted on the housing.

14. A locking or latching mechanism installed on a door and door frame, the mechanism comprising a striker extending from the door and having an enlarged head, a housing connected to the door frame, and a keep, the keep including an opening through which the enlarged of the striker can pass, in which the mechanism is in a locked or latched condition when the enlarged head of the striker is received and retained by the keep, the keep being formed as a part separate from the housing but provided loosely within the housing to permit relative movement between the keep and housing enabling automatic alignment between the striker and the keep when the striker is moved towards and into the keep via movement of the door toward the door frame, wherein the housing is configured and sized to retain the keep therein while at the same time permitting relative movement between the keep and the housing.

* * * * *

UNITED STATES PATENT AND TRADEMARK OFFICE

CERTIFICATE OF CORRECTION

PATENT NO. : 6,607,224 B2
DATED : August 19, 2003
INVENTOR(S) : Andrew Hodges

It is certified that error appears in the above-identified patent and that said Letters Patent is hereby corrected as shown below:

Column 6,
Line 32, after the word "keep" insert -- "and housing enabling automatic alignment between the striker and the keep" --
Line 62, change "A mechanism according to claim 1" to -- "A locking or latching mechanism" --

Column 8,
Line 2, after the word "enlarged" insert -- "head" --

Signed and Sealed this

Seventh Day of September, 2004

JON W. DUDAS
*Director of the United States Patent and Trademark Office*